United States Patent [19]

Feldman

[11] Patent Number: 4,997,207

[45] Date of Patent: Mar. 5, 1991

[54] NOTEBOOK COVER RESTRAINING SYSTEM AND METHOD OF USE

[76] Inventor: Richard L. Feldman, 10350 N. 142nd St., Lincoln, Nebr. 68462

[21] Appl. No.: 369,705

[22] Filed: Jun. 22, 1989

[51] Int. Cl.[5] ..... B42D 1/00

[52] U.S. Cl. ..... 281/18; 402/73; 402/502

[58] Field of Search ..... 402/73, 70, 502, 80 R; 281/18, 20, 29

[56] References Cited

U.S. PATENT DOCUMENTS

| | | | |
|---|---|---|---|
| 1,337,612 | 2/1920 | Miller | 281/20 |
| 1,726,684 | 4/1929 | Sollum | 281/20 |
| 2,550,386 | 5/1951 | Shepard | 402/70 |
| 2,757,939 | 7/1956 | Fenkel | 281/20 |
| 4,488,645 | 12/1984 | Yamaguchi | 281/18 X |
| 4,524,991 | 6/1985 | Thomas | 281/20 |
| 4,531,764 | 7/1985 | Chang | 281/29 |
| 4,569,613 | 9/1986 | Thomas | 402/80 R |
| 4,744,689 | 4/1988 | Sternberg | 402/73 |

FOREIGN PATENT DOCUMENTS

| | | | |
|---|---|---|---|
| 675955 | 9/1939 | Fed. Rep. of Germany | 281/20 |
| 2513942 | 1/1983 | France | 281/18 |
| 15063 | 6/1906 | Norway | 281/20 |
| 94775 | 11/1875 | United Kingdom | 281/20 |

*Primary Examiner*—Paul A. Bell
*Attorney, Agent, or Firm*—James D. Welch

[57] ABSTRACT

A notebook cover restraining system and method of use is disclosed. The system provides that a short extension be attached to a notebook cover by means which have a natural tendency to assume a flat shape. The system also provides that complimentary hook structures be placed on the edge of the short extension, and on the edge of the notebook cover which does not have the short extension attached thereto. In the preferred embodiment both hook structure equipped edges are distal to the notebook back binder. In use one can very easily cause the short extension to rotate around the attachment point locus between the short extension and the notebook cover to which it is attached, to a position at which the hook structures can be caused to mesh and secure the notebook in a closed position with the top and bottom covers oriented parallel with respect to one another. Just as easily the notebook can be reopened, and the short extension allowed to naturally assume a position which is projected from and coplanar with the notebook cover to which it is attached due to "spring-action" torsion force created by the attachment means between the notebook cover and the short extension. In said position the short extension does not obstruct use of the notebook, for instance while taking notes. In addition, the short extension does not protrude beyond the normal outer peripheral surfaces of notebook covers when the notebook is closed, hence, it does not interfere with other notebooks which are located adjacent to the notebook fitted with the invention. This makes insertion or extraction of an individual notebook from a shelf containing many such notebooks easy.

9 Claims, 1 Drawing Sheet

NOTEBOOK COVER RESTRAINING SYSTEM AND METHOD OF USE

TECHNICAL FIELD

This invention relates to notebooks and more particularly to a very convenient system and method of use, for restraining the open ends thereof in a closed position such that the top and bottom covers are parallel to one another.

BACKGROUND

Most people are familiar with the problems associated with the use of notebooks, which problems are caused by the tapering shape dimension between the back binder and the cover open ends distal to the back binder. Stacking of horizontally oriented notebooks vertically atop one another or placing vertically oriented upright notebooks horizontally side by side between bookends, for instance is very inconvenient. A search of existing Patents, however, has shown that relatively little has been done to overcome the problems until very recently.

In 1985 a Patent to Chang, U.S. Pat. No. 4,531,764 issued for a loose leaf binder spacer. The purpose of the Chang invention is to provide a system for use inside notebooks which can be adjusted to keep the covers of the so equipped notebook parallel when the notebook is closed, but not completely filled with loose leaf papers. The Chang invention can be described as a strip of material in which three bend point locuses are placed at 90 degree angles to the longitudinal dimension of the strip. At both ends of the strip, on the top thereof as one views the strip in side elevation with its bottom surface resting on a horizontal support, are placed connectors, such as hook and loop type with the hooks being at one end and the loops at the other end of the strip. The operation of the invention can best be understood by visualizing the strip from a side elevational view as alluded to above. The strip length to the right of the first bend point locus closest to the left side of the strip is caused to rotate counterclockwise around the first bend point locus, as is the next strip length to the right of the second bend point locus, around the second bend point locus. The strip length to the right of the third bend point locus, closest to the right side of the strip, is caused to rotate clockwise around the third bend point locus, in a fashion such that the connectors at the right and left sides of the strip contact. It will be appreciated that the horizontal portions of the strip so oriented, (i.e. the right and left sides of the strip as originally viewed), now both at the left side of the strip can, when the connectors are separated, be slid respectively by one another. Such a motion leads the elevated peak which forms at the second bend point locus to vary in height above the height of the furthest left portion of the strip, as originally viewed, as a result. Placing the Chang invention inside a notebook, affixed to the upper inside surface of the bottom cover of same allows one to create a spacer of the proper dimension to cause the closed covers of the so equipped notebook to be oriented parallel to one another, when the notebook is not completely filled with loose leaf paper.

Sternberg was granted a U.S. Pat. No. 4,774,689 in 1988 for a system using a different approach to solving the problem of interest herein. The primary Sternberg approach involves adding a rather long extension to the bottom cover of a notebook, which extension has affixed to it, on its upper surface and just adjacent to the open edge of the bottom notebook cover distal to the notebook back binder, (as one views the notebook in elevation from the bottom of the notebook as the lower outside surface of the notebook's bottom cover rests on a horizontal support), a rectangular block. Also on the upper surface of the long extension affixed to the bottom notebook cover is a connector means, such as one element of a loop and hook connector combination. On the upper outer surface of the top notebook cover is located the other element of the connector means. The long extension affixed to the bottom notebook cover has a bend point locus oriented at 90 degrees to the longitudinal dimension of the long extension which is just beyond the right extent of the rectangular block when viewed as alluded to above. The length of the rectangular block plus the thickness of the top notebook cover is set equal to the elevational height of the notebook back binder above the top of the bottom notebook cover. In use one rotates the long extension counterclockwise around the attachment point locus at which the long extension is affixed to the bottom notebook cover until the leftmost side of the rectangular block meets the upper inner surface of the bottom notebook cover and causes the rotation to cease. At this point the rectangular block and the affixed portion of the long extension will be oriented at 90 degrees to the horizontal bottom notebook cover. The top notebook cover can then be rotated clockwise around the attachment point locus at which it is attached to the notebook back binder so that its open end distal to the notebook back binder rests on the rectangular block on the side thereof which was originally the rightmost aspect thereof prior to the counterclockwise rotation of the long extension and the affixed rectangular block around the attachment point locus between the open end of the bottom notebook cover distal to the notebook back binder and the long extension. To complete the operation the portion of the long extension which was originally to the right of the aforementioned bend point locus can be rotated counterclockwise so that the two elements of the aforementioned connector means meet. At this point the notebook is found to be closed with the top and bottom covers in a parallel orientation with respect to one another. An alternative Sternberg approach involves a shorter extension with one element of a hook and loop connector on the far right side of the rectangular block. The complimentary connector element is placed on the inside surface of the top notebook cover along the open edge distal to the notebook back binder. In use the shorter extension can be rotated as described with respect to the long extension and the top cover caused to rotate as previously described so that the connector elements make contact.

Another approach to solving the problem of interest is taught in two patents to Thomas, namely U.S. Pat. Nos. 4,565,613 and 4,524,991, which issued in 1986 and 1985 respectively. The approach in said patents is to construct snap-on devices which are of proper size for use on existing notebooks. Present on the devices are configurations which are of proper size and orientation to clamp to the open edges of the notebook covers, which edges are distal to the notebook back binder. When such a device is snapped in place the resulting secured notebook presents itself with the top and bottom notebook covers oriented parallel to one another.

While the inventions described do provide end results which are desirable, they have certain drawbacks. For instance, the Chang Invention tends to cause damage such as creases to develop in papers kept in notebooks equipped with the invention and adjustment must be performed when the amount of loose leaf paper in a notebook equipped with the system is changed to keep the notebook covers parallel to one another. The Sternberg invention has, in the primary form, a very long extension on the bottom notebook cover and such is very inconvenient when one attempts to use the notebook, for instance, when taking notes therein at a small desk. While the alternate Sternberg approach has a shorter extension attached to the bottom notebook cover, a notebook incorporating the alternate device is difficult to open when the elements of the hook and loop connector means are coupled, and the shorter extension, like the longer extension of the primary Sternberg invention, with the rectangular block attached thereto, inconveniently hangs from the bottom notebook cover when the notebook is not closed. Additionally, many of the inventions discussed require that elements project beyond the normal outer peripheral surfaces of the notebook covers when the notebook is closed, thereby making easy sliding of closed notebooks which incorporate the inventions, into and out of tight spaces between other notebooks and bookends etc., difficult. The protruding elements tend to catch adjacent notebooks for instance and cause them to move along with the notebook of interest. The Thomas devices have this and another obvious drawback in that they are not attached permanently to a notebook cover, hence can be easily lost, or improperly placed upon a wrong notebook. The later problem can develop when identification markings are placed upon the devices.

In summary then, important drawbacks of existing inventions include:

(1) Devices which mount inside a notebook present the possibility that papers in the notebook will be creased;

(2) Inconveniently long extensions which hang from a notebook cover when the notebook is open makes the use of a notebook difficult, particularly in tight quarters;

(3) Notebook covers secured by hook and loop connectors can be difficult to open;

(4) Projections beyond the normal outer peripheral surfaces of notebook covers make stacking of horizontally oriented notebooks vertically, or sliding vertically oriented upright notebooks horizontally side by side by one another difficult;

(5) Devices which are not permanently attached to notebook covers can be easily lost or attached to improper notebooks thereby providing improper identification.

In view of the drawbacks identified, a need is seen to exist for an invention which serves to restrain notebooks in a closed position in which the covers are positioned parallel to one another, which invention:

(1) Does not mount inside a notebook where it can possibly damage papers;

(2) Does not require that unnecessarily long extensions be attached to notebook covers;

(3) Provides an easy to operate system and method of its use, which system requires no unusual force to operate and preferably can be operated with one hand by a motion similar to that required to open a book cover;

(4) Does not require any elements of the system to project beyond the normal outer peripheral surfaces of the notebook;

(5) Is permanently attached to a notebook cover to prevent loss or attachment to an improper notebook.

The system preferably should also provide means by which the papers inside a closed notebook can be protected against damage by external agents entered from the normally open space at the edges of the notebook covers. The system should also provide for definitely positioning any short extension from a cover in a convenient position when the notebook is not closed so that it does not interfere with the use of the notebook. The system also, should not require periodic adjustment to align notebook covers in a parallel configuration. Also, any extension from a notebook cover should be as simple in construction as is possible, and in particular should not have any rectangular blocks attached thereto.

DISCLOSURE OF THE INVENTION

The present invention meets the need identified in the Background Section. The present invention meets the need by providing, in the preferred embodiment, a hook structure on a top notebook cover at the open edge thereof, distal to the notebook back binder, and a short extension affixed to a bottom notebook cover distal to the notebook back binder, which short extension has a complimentary hook structure thereon. The short extension, in the preferred embodiment, is affixed to the bottom notebook cover by attachment means which provide a tendency to cause the short extension to assume and retain a projected coplaner orientation from the bottom notebook cover to which it is attached, but which allows for rotation around the attachment point locus. The action of the invention can be best understood while a notebook is viewed in elevation from the bottom thereof as the lower outside surface of the notebook's bottom cover rests on a horizontal support with the notebook back binder oriented to the left. As so viewed it will be appreciated that the short extension affixed to the bottom cover of a notebook extends to the right in its natural position coplaner with the bottom notebook cover. In use one can cause the short extension to rotate counterclockwise through an angle greater than 90 degrees. While held in said position the top notebook cover can be rotated clockwise around its back binder attachment point locus to the position at which it assumes an orientation parallel to the bottom notebook cover. Simply releasing the short extension at that point causes the hook structures already identified to mesh, thereby securing the notebook in a closed position, with the natural torsion force produced by the attachment means effecting a firm positively reinforced engagement between the hook structures. To reopen the notebook one must simply push on the short extension to cause it to rotate to an angle greater than 90 degrees counterclockwise around its notebook bottom cover attachment point locus, rotate the top notebook cover counterclockwise around its notebook back binder attachment point locus to raise the hook structure thereon above the hook structure on the short extension, and release the short extension. When released the short extension will naturally assume an orientation projected from and coplaner with the bottom notebook cover, as already alluded to. It will be appreciated that the procedure to open the closed notebook requires a natural action on the part of one using the invention, much the same as the action required to simply open a book's top cover, which action, it is noted, requires only one hand. The hook structures disengage easily, unlike the elements of hook and loop type connectors as are present in the Sternberg inventions, yet serve to restrain a notebook in a closed position because of the torsion force present at the meshing hook structures which is produced by the attachment means between the short extension and the bottom notebook cover.

The attachment means between the short extension and the bottom notebook cover can comprise two strips of material which have the tendency to remain flat in shape. One strip can be attached to the lower surfaces of the bottom notebook cover and the short extension, while the other strip can be attached to the upper surfaces of the same elements. It has been found that a groove etched longitudinally along the longitudinal midpoint locus of the strip attaching the upper surfaces of the bottom notebook cover and the short extension aids with the action of the invention. The groove causes the attachment means to favor rotation in the functional direction and disfavor rotation in the opposite direction. This serves to position the short extension positively both when the notebook is open and closed. Other such "spring-action" torsion force producing functionally equivalent attachment means are within the scope of this invention, and the Claims herein are to be interpreted to include such functional equivalents, including an embodiment wherein the groove alluded to is not present.

The hook structures can be continuous along the respective open edge locuses of the top notebook cover distal to the notebook back binder and the far right edge of the short extension (viewed as described above), or only a portion of said locuses might be provided with the hook structure, or multiple such structures can exist along the respective identified locuses. The hook structures might also be present on the top and bottom open edges of notebook covers, and complimentary attached short extensions, in addition to, or instead of at the locations described, distal to a notebook back binder. Additionally, the short extension might be attached to the top notebook cover and the complimentary hook structure to the bottom notebook cover. It is also noted that any functional equivalent to the hook structures is within the scope of the present invention and the term, "hook structure" shall be interpreted to include such functional equivalents.

SUMMARY OF THE INVENTION

Inventions which serve to fix notebook covers in planes parallel to one another when the notebook is closed are known in the art. Known inventions, however, have drawbacks such as requiring that unnecessarily long extension be affixed to notebook covers, or that devices which are not permanently attach to notebooks, hence can be easily lost, be used. Another problem with some inventions is that they physically contact papers within a notebook and can cause damage such as creases in same. Yet another problem is that some of the inventions require that protrusions extend beyond the normal outer peripheral surfaces of the notebook covers thereby making sliding a notebook with respect to another on the side thereof difficult. Still other drawbacks exist because of the presence of hard to operate connector means in the system and the need to adjust some invention systems as the amount of paper in an equipped notebook is changed. A need exists for an invention which overcomes the drawbacks identified in prior inventions.

The need for a system, and method of use, which system operates conveniently and easily to orient top and bottom notebook covers parallel to one another when the notebook is closed, and which system attaches permanently to notebooks to prevent loss, but which system does not require that unnecessarily long, use inhibiting extensions be affixed to notebook covers, or that attachments which extend beyond the normal outer peripherial surfaces of the notebook be present, and which system does not require the presence of hard to use connector means or require adjustment when the amount of paper in a notebook is changed, is provided by the present invention.

In view of the foregoing, a first purpose of the present invention is to provide a convenient, easy to use system which requires no unusual force to operate and preferably can be operated with one hand by a motion similar to that required to open a book, the method of use of which provides that covers of closed notebooks utilizing the system are oriented parallel to one another.

Another purpose of the present invention is to achieve the first purpose in a fashion which does not require that extensions which are unnecessarily long or of complex construction be affixed to notebook covers, or that easily lost devices which are not attached to a notebook be required.

Yet another purpose of the present invention is to achieve the first purpose in a fashion which does not require any element of the invention to contact papers within a notebook, which elements might have a tendency to damage said papers.

Yet still another purpose of the present invention is to achieve the first purpose by use of attachment means which cause any extension of a notebook cover to naturally assume a projected coplaner orientation from the notebook cover to which it is attached, when the notebook is not closed.

Further, another purpose of the present invention is to achieve the first purpose by means of a system that does not require the use of hard to operate connector means, such as hook and loop type connectors.

Still another purpose of the present invention is to achieve the first purpose by means of a system that does not require that any element project beyond the normal peripheral surfaces of the notebook.

Yet still another purpose is to achieve the first purpose by means of a system that does not require periodic adjustment of the system to keep the top and bottom covers of a closed notebook parallel when the notebook is closed.

Further, another purpose of the present invention is to achieve the first purpose by means of a system which helps to prevent damage to papers inside a closed notebook by acting as a barrier to external agents.

DETAILED DESCRIPTION

Figure 1:
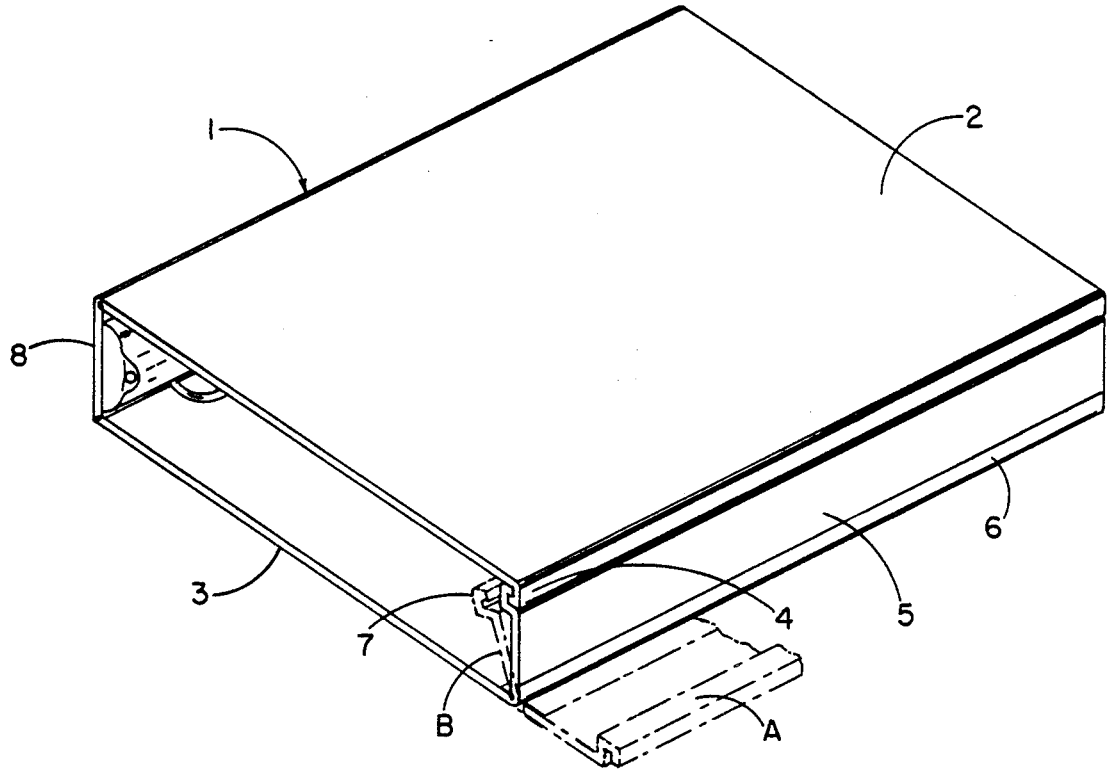
FIG. 1 shows a perspective elevational view of a notebook with a short cover restraining extension attached to the bottom cover, as the notebook is viewed from above and at a distance from the lower right corner of the notebook while the notebook rests with the lower surface of its bottom cover resting on a horizontal support, and with the bottom and open ends of the notebook covers distal to the notebook back binder positioned to the right in the figure.

Referring now to the drawings, the preferred embodiment is described. FIG. 1 shows a perspective view of a notebook (1), as the notebook is supported on the lower outer surface of its bottom cover by a horizontal support. The bottom and right side of the notebook are seen in perspective elevation from the above the notebook at a distance therefrom. The top cover (2) is shown to be in a plane parallel to that of the bottom cover (3) when the notebook is in the closed position, (i.e. represented by solid lines). In the closed position, hook structure (4), along the top notebook cover open edge distal to the notebook back binder (8), meshes with the complimentary hook structure (7), which complimentary hook structure (7) is present along the short extension (5) edge distal to the attachment means (6), which attachment means (6) attaches the short extension (5) to the bottom notebook cover (3) at its edge distal to the notebook back binder (8). The vertical width dimension of the short extension (5), when combined with the vertical dimension provided by the attachment means (6), serves to position the hook structures (4) and (7) so that when they mesh in the closed notebook position the notebook covers (2) and (3) are parallel. That is, the vertical width dimension alluded to is set, in fabrication, by reference to the notebook back binder vertical width dimension. Note, extension and hook structures can also be placed on the top or bottom open edges of notebook covers, in addition to, or instead of, at the open edges of notebook covers as described, distal from the notebook back binder, and the claims are to be interpreted to include such a reading. The location of the hook structures shown in the drawings is thus demonstrative, not exclusive.

Still referring to FIG. 1, there are shown two phantom views, labeled "A" and "B". Phantom view "A" shows the short extension (5) attached to the bottom notebook cover (3) by way of attachment means (6). When the short extension (5) is not restrained by the meshing of hook structures (4) and (7) as when the notebook is not in the closed position, the "spring-action" torsion force producing properties of the attachment means (6) cause the short extension (5) to assume the position shown in phantom view "A", which position is a coplaner projection from bottom notebook cover (3). Phantom view "B" exemplifies how the short extension (5) can be rotated counterclockwise around the attachment means (6) contact point locus with the bottom notebook cover (3) past the 90 degree position. In said position it will be appreciated that the hook structures (4) and (7) will not be in mesh. The top notebook cover (2) can be rotated around its attachment point locus to the notebook back binder (8) without interference by hook structure (7). If the top notebook cover (2) is open, a clockwise rotation will bring it into a position such that short extension (5) can naturally recoil, due to the torsion force provided by the attachment means (6), clockwise around its attachment point locus with bottom notebook cover (3), thereby causing the hook structures (4) and (7) to mesh and secure the notebook (1) in the closed orientation. Still referring to Phantom View "B", if the top notebook cover is in the closed position, parallel to the bottom notebook cover, it can be rotated counterclockwise about its attachment point locus to the notebook back binder (8), and the short extension (5) let free to recoil to the open notebook position shown in Phantom View "A".

It should be apparent that simple user action can operate the mechanism of the invention. One need only push on the short extension (5) to cause its counterclockwise rotation, as viewed in FIG. 1, to either close or open the notebook (1). Also note that the short extension (5) is not any longer than absolutely necessary to accomplish the function intended and does not protrude beyond the outside of the notebook's natural peripheral boundaries, hence, it does not interfere with the stacking or sliding, respectively, of notebooks placed atop thereof or to the side thereof. No inconvenient unnecessarily long extension is present to obstruct use of the notebook in cramped quarters etc., and the short extension present is naturally restrained in an out of the way position when the notebook is in use. Additionally, the short extension (5) is firmly secured to the bottom notebook cover (3), hence, loss as a result of removal is not a problem.

Figure 2:
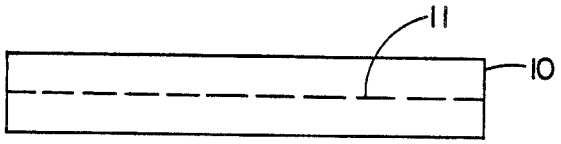
FIG. 2 shows a top view of a first strip of material which has a natural tendency to assume a flat shape and which is used as attachment means.
Figure 3:
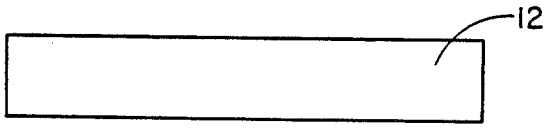
FIG. 3 shows a top view of a second strip of material which has a natural tendency to assume a flat shape and which is used as attachment means.
Figure 4:
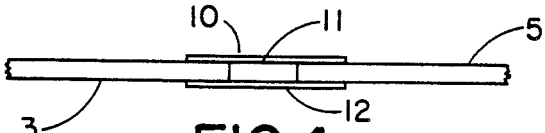
FIG. 4 shows a partial cut away bottom elevational view of a notebook cover and extension attached thereto by way of the two strips of material which have a natural tendency to assume a flat shape.

Referring now to FIGS. 2, 3 and 4 a preferred embodiment of the attachment means (6) is shown. FIG. 2 shows a top view of a first strip of material (10) which has a natural tendency to assume a flat shape. The first strip of material (10) is shown with a groove (11) etched along its longitudinal midline locus. FIG. 3 shows a strip of material (12), viewed similarly to the first strip of material (10) in FIG. 2, which also has a natural tendency to assume a flat shape. FIG. 4 shows a partial cut away view of the bottom notebook cover (3) and the short extension (5), with the first strip of material (10) attaching the upper surfaces of the bottom notebook cover (3) and the short extension (5). The second strip of material (12) serves to attach the lower outer surface of the bottom notebook cover (3) to the lower surface of the short extension (5). The groove (11) in the first strip of material (10) serves to improve the action described in conjunction with Phantom View "A" and "B", but is not essential to the invention. However, it is to be noted that the groove (11) creates a focal point locus that controls the displacement of item (10) thereby causing a "snap-action" to occur when the short extension is caused to rotate counterclockwise, thereby facilitating the rotation in the counterclockwise direction. When it is attempted to rotate the short extension (5) in a clockwise direction from the notebook open position, e.g. phantom view "A", it is found that the lack of a groove in the second strip of material (12) causes resistance to said attempted clockwise rotation by not allowing compressive forces to divert. This is beneficial in keeping the short extension fixed in a projected coplaner orientation with the bottom notebook cover when the notebook is open.

It will be appreciated that attachment means which perform the same torsion force producing "spring-action" function as those described in conjunction with FIGS. 2, 3 and 4 are within the scope of this invention and the described attachment means is demonstrative, rather than exclusive.

The present invention can be originally fabricated into a notebook, or added thereto by retrofit. Additionally, short extension (5) could be mounted to a top notebook cover and a complimentary hook structure placed on a bottom notebook cover, and the hook structures can be placed on the top and bottom open edges of the notebook covers instead of, or in addition to, at the notebook cover open edges distal from the notebook back binder. The configuration described herein is, again, demonstrative and not exclusive and the claims are to be interpreted to include any functionally equivalent placement.

Having hereby disclosed the subject matter of this invention, it should be obvious that many modifications, substitutions and variations of the present invention are possible in light of the teachings. It is therefore to be understood that the invention may be practised other than as specifically described, and should be limited in breadth and scope only by the claims.

I claim:

1. A notebook cover restraining system for use with notebooks which comprise a notebook back binder and two notebook covers, which notebook covers are attached to the notebook back binder by attachment means which allow rotation of at least one said notebook cover with respect to the notebook back binder around its associated notebook cover attachment point locus, which notebook covers present edges distal to the notebook back binder; which notebook cover restraining system comprises:

a hook structure firmly attached to one said notebook cover along at least part of the length of the edge distal to the notebook back binder, which hook structure projects toward the notebook back binder;

a short extension attached by way of attachment means along at least part of the edge of the second notebook cover distal to the notebook back binder, which short extension has along at least part of the length of its edge distal to the locus of attachment to the edge of the second notebook cover a complimentary hook structure, which complimentary hook structure projects away from the notebook back binder when the short extension is oriented parallel to the notebook back binder by rotation around its attachment locus to the second notebook cover in a direction toward the first notebook cover;

which attachment means between the short extension and the edge of the second notebook cover distal to the notebook back binder provides a tendency to the short extension to assume an orientation projecting from and coplaner with the second notebook cover to which the short extension is attached by said attachment means when the short extension is not subject to externally applied forces;

which short extension can be caused to rotate about its locus of attachment to the edge of the second notebook cover distal to the notebook back binder and positioned so that the hook structure along at least part of the length of the edge of one notebook cover meshes with the complimentary hook structure along at least part of the length of the edge of the short extention attached to the second notebook cover and thereby restrain the notebook in a closed position.

2. A notebook cover restraining system as in claim 1 in which the short extension is of a dimension appropriate to cause the notebook covers to assume an orientation parallel to one another when the notebook is restrained in a closed position, which short extension does not protrude beyond the normal boundaries of the notebook cover restraining system equipped notebook, thereby allowing closed restrained notebooks to be stacked next to one another and removed from the stack without dislodging adjacent closed notebooks.

3. A notebook cover restraining system as in claim 2 in which the short extension attached to the edge of the second notebook cover distal to the notebook back binder is continuous along the entire length of said edge of the second notebook cover distal to the back binder thereby allowing the short extension to act as a protector with respect to materials contained within the notebook when the notebook is in a closed restrained position.

4. A notebook cover restraining system as in claim 1 in which the attachment means which attaches the second notebook cover to the short extension is comprised of two strips of material which material has a tendency to assume and retain a flat shape, one of said strips of material being applied to attach the top surface of the second notebook cover to the top surface of the short extension, and the second said strip of material bieing applied to attach the bottom of the second notebook cover to the bottom of the short extension, with top and bottom being viewed when the notebook is set atop a horizontal surface with the second notebook cover parallel thereto.

5. A notebook cover restraining system as in claim 4 in which the top strip of material has a groove etched therein, which groove is parallel to the edge of the second notebook cover which is distal to the notebook back binder, and which groove is between the locuus at which the top strip of material is attached to the second notebook cover and the locus at which strip of material is attached to the short extension.

6. A notebook, which notebook comprises a notebook back binder and two notebook covers, which notebook covers are attached to the notebook back binder by attachment means which allow rotation of at least one said notebook cover with respect to the notebook back binder around the associated notebook cover attachment point locus between said notebook back binder and notebook cover, which notebook covers present edges distal to the notebook back binder; which notebook further comprises a notebook cover restraining system comprising:

a hook structure firmly attached to one said notebook cover along at least part of the length of the edge distal to the notebook back binder, which hook structure projects toward the notebook back binder;

a short extension attached by way of attachment means along at least part of the edge of the second notebook cover distal to the notebook back binder, which short extension has along at least part of the length of its edge distal to the locus of attachment to the edge of the second notebook cover a complimentary hook structure, which complimentary hook structure projects away from the notebook back binder when the short extension is oriented parallel to the notebook back binder by rotation around its attachment locus to the second notebook cover in a direction toward the first notebook cover;

which attachment means between the short extension and the edge of the second notebook cover distal to the notebook back binder provides a tendency to the short extension to assume an orientation projecting from and coplaner with the second notebook cover to which the short extension is attached by said attachment means when the short extension is not subject to externally applied forces;

which short extension can be caused to rotate about its locus of attachment to the edge of the second notebook cover distal to the notebook back binder and positioned so that the hook structure along at least part of the length of the edge of one notebook cover meshes with the complimentary hook structure along at least part of the length of the edge of the short extension attached to the second notebook cover and thereby restrain the notebook in a closed position.

7. A notebook as in claim 6 in which the short extension is of a dimension appropriate to cause the notebook covers to assume an orientation parallel to one another when the notebook is restrained in a closed position, which short extension does not protrude beyond the normal boundaries of the notebook cover restraining system equipped notebook, thereby allowing closed restrained notebooks to be stacked next to one another and removed from the stack without dislodging adjacent closed notebooks.

8. A notebook as in claim 7 in which the short extension attached to the edge of the second notebook cover distal to the notebook back binder is continuous along the entire length of said edge of the second notebook cover distal to the notebook back binder thereby allowing the short extension to act as a protector with respect to materials contained within the notebook when the notebook is in a closed restrained position.

9. A method of securing notebooks in a closed position, which method comprises the steps of:

grasping a notebook, which notebook is of the type comprising a back binder and two notebook covers, which notebook covers are attached to the notebook back binder by attachment means which allow rotation of at least one said notebook cover with respect to the notebook back binder around its associated attachment point locus, which notebook covers present edges distal to the notebook back binder; which notebook further comprises a notebook cover restraining system comprising:

a hook structure firmly attached to one said notebook cover along at least a part of the length of the edge distal to the notebook back binder, which hook structure projects toward the notebook back binder;

a short extension attached by way of attachment means along at least part of the edge of the second notebook cover distal to the notebook back binder, which short extension has along at least part of the length of its edge distal to the locus of attachment to the edge of the second notebook cover a complimentary hook structure, which complimentary hook structure projects away from the notebook back binder when the short extension is oriented parallel to the notebook back binder by rotation around its attachment locus to the second notebook cover in a direction toward the first notebook cover;

which attachment means between the short extension and the edge of the second notebook cover distal to the notebook back binder provides a tendency to the short extension to assume an orientation projecting from and coplaner with the second notebook cover to which the short extension is attached by said attachment means when the short extension is not subject to externally applied forces;

which short extension can be caused to rotate about its locus of attachment to the edge of the second notebook cover distal to the notebook back binder and be positioned so that the hook structure along at least part of the length of the edge of one notebook cover meshes with the complimentary hook structure along at least part of the length of the edge of the short extension attached to the second notebook cover and thereby restrain the notebook in a closed position;

causing the notebook to assume an open orientation in which the notebook covers project distally at an accute angle with respect to one another from the location of the notebook back binder to which the notebook covers attach;

causing the short extension to rotate about its attachment locus to the second notebook cover toward the first notebook cover to position it just past an orientation parallel to the notebook back binder;

causing the notebook covers to assume a position essentially parallel to one another; and allowing the short extension to naturally recoil causing the hook structure and complimentary hook structure to mesh with one another, thereby orienting the notebook in a closed position.

* * * * *